US010238202B2

(12) United States Patent
Serposi

(10) Patent No.: US 10,238,202 B2
(45) Date of Patent: Mar. 26, 2019

(54) BRUSH FOR THE APPLICATION OF COSMETIC PRODUCTS

(71) Applicant: PENNELLI FARO S.R.L., Casalmaggiore (IT)

(72) Inventor: Gianluca Serposi, Casalmaggiore (IT)

(73) Assignee: Pennelli Faro S.r.l., Casalmaggiore (IT)

( * ) Notice: Subject to any disclaimer, the term of this patent is extended or adjusted under 35 U.S.C. 154(b) by 0 days.

(21) Appl. No.: 15/567,000

(22) PCT Filed: Feb. 23, 2016

(86) PCT No.: PCT/IB2016/050977
§ 371 (c)(1),
(2) Date: Oct. 16, 2017

(87) PCT Pub. No.: WO2016/166615
PCT Pub. Date: Oct. 20, 2016

(65) Prior Publication Data

US 2018/0084897 A1 Mar. 29, 2018

(30) Foreign Application Priority Data

Apr. 17, 2015 (IT) ..... MO2015A0085

(51) Int. Cl.
*A46B 9/02* (2006.01)
*A46B 9/06* (2006.01)

(52) U.S. Cl.
CPC ..... *A46B 9/028* (2013.01); *A46B 9/021* (2013.01); *A46B 9/06* (2013.01); *A46B 2200/1046* (2013.01)

(58) Field of Classification Search
CPC ..... A46B 9/021; A46B 9/028; A46B 9/06; A46B 2200/1046
See application file for complete search history.

(56) References Cited

U.S. PATENT DOCUMENTS 4,088,413 A 5/1978 Rossignol de la Ronde et al.
4,454,622 A 6/1984 Poppendieck
(Continued)

FOREIGN PATENT DOCUMENTS

DE 528920 C 7/1931
WO 2015/025873 A1 2/2015

OTHER PUBLICATIONS

International Search Report and Written Opinion dated Jun. 24, 2016 from International Patent Application No. PCT/IB2016/050977, filed Feb. 23, 2016.

*Primary Examiner* — Randall Chin
(74) *Attorney, Agent, or Firm* — David B. Tingey; Bryant J. Keller; Kirton McConkie

(57) ABSTRACT

A brush for the application of cosmetic products, including a grip body having at least a housing seat made to measure for a plurality of hairs adapted to take, apply and spread cosmetic products on a user, in which the plurality of hairs is divided into: a first group of hairs adjacent to one another and fitted to measure in the housing seat and defining a convex spreading surface which is adapted to spread the cosmetic products on the user; and a second group of hairs adjacent to one another and inserted in the first group of hairs, defining a taking and application surface which is protruding with respect to the spreading surface and has a substantially pointed shape and is suitable for taking the cosmetic products and for their point-like application on the user.

11 Claims, 4 Drawing Sheets

(56) References Cited

U.S. PATENT DOCUMENTS

| | | | | | |
|---|---|---|---|---|---|
| 4,483,036 | A * | 11/1984 | Sayklay | A46B 9/02 | 15/160 |
| 5,159,736 | A * | 11/1992 | Newell | A46B 3/04 | 15/190 |
| 5,220,702 | A * | 6/1993 | Howell | A46B 9/06 | 15/159.1 |
| 2004/0003478 | A1 * | 1/2004 | Mink | A46B 9/021 | 15/160 |
| 2010/0077559 | A1 | 4/2010 | Mink | | |

* cited by examiner

Fig.4
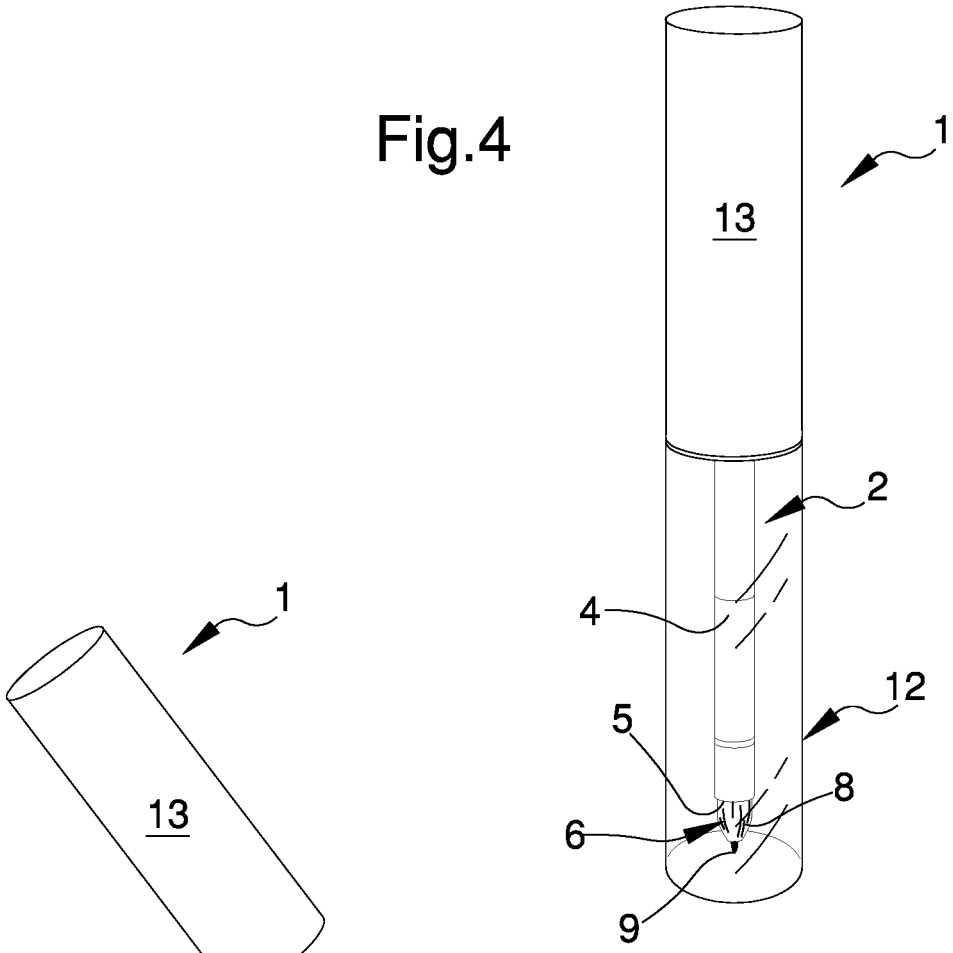
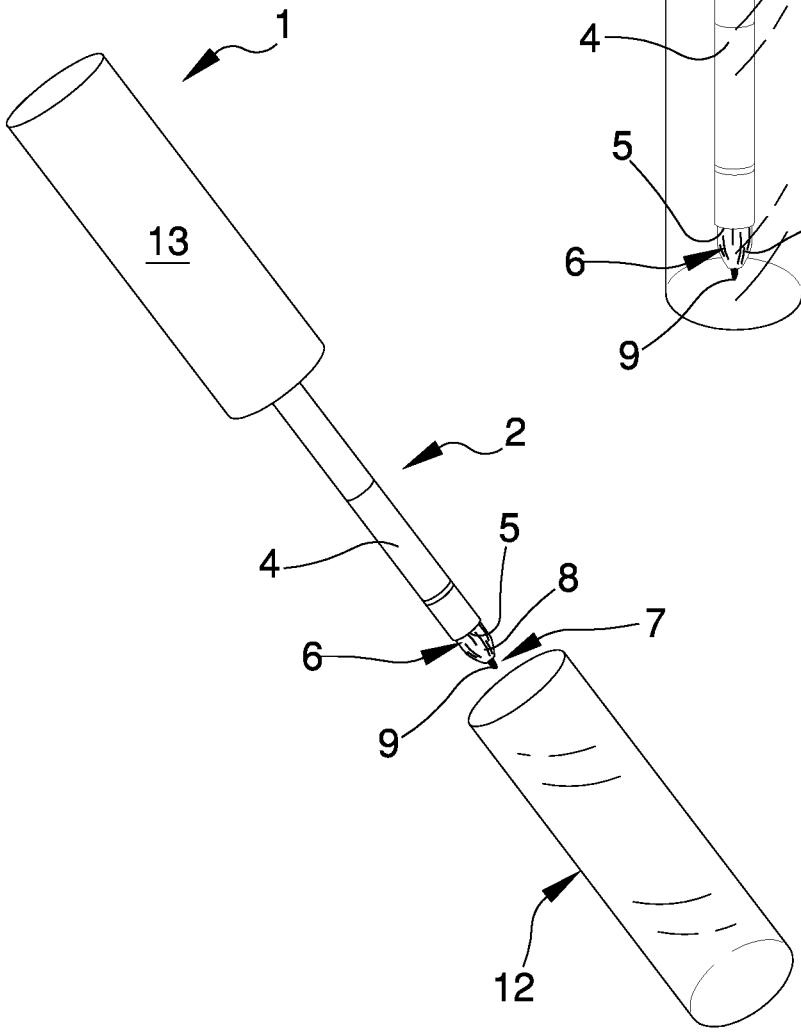
Fig.5

BRUSH FOR THE APPLICATION OF COSMETIC PRODUCTS

TECHNICAL FIELD

The present invention relates to a brush for the application of cosmetic products.

BACKGROUND ART

In cosmetics, techniques are known for the application of products such as creams, face powders, bronzing powders, foundations, concealers, etc. which provide for the use of special brushes both to take the required amount of product from the container and to apply the product on some particular points of the face and of the human body in general.

Several types of brush exist that differ both in form and size, to be used based on the type of application and on the aesthetic result to be obtained.

In general, all brushes have a grip body particularly adapted to be grasped and held in the hand by a user.

The grip body, usually elongated, comprises an end portion having a special opening adapted to house a plurality of hairs composing the head of the brush itself, i.e. the part of the brush adapted to take the product and apply the same on the users' face.

The plurality of hairs is partly inserted in the opening so as to be surrounded by the end portion of the grip body and retained therein by means of glue or other adhesive substances.

The portion of hairs escaping from the opening, depending on the shape of the opening itself and on the insertion technique, gives the head of the brush different conformations depending on the type of brush.

There are brushes the heads of which have a voluminous conformation, with the plurality of hairs protruding from the opening which takes, e.g., the shape of a spherical cap, or of a different three-dimensional shape.

There are also brushes the head of which is flat, with the plurality of hairs protruding from the opening which takes, e.g., an enlarged fan-shaped conformation.

These types of known brushes have some drawbacks related to the different types of required applications.

The voluminous brushes, e.g., are not particularly suitable for applications that require a certain precision such as, e.g., to obtain multicolored effects or to make up only certain parts of the face (eyes, mouth and the like).

In fact, in the case of this kind of applications, the bulkiness of these brushes prevents the achievement of precision results, with unsatisfactory final visual effects.

Similarly, the brushes with a flattened and enlarged head are uncomfortable and offer little performance for precision applications such as those mentioned above, with poor final results.

Both in the case of voluminous brushes and in the case of brushes with flattened and enlarged head, the conformation of the head prevents to take the cosmetic products in a homogeneous manner, significantly affecting the final visual effect.

In precision applications it is known to use specially designed brushes having, e.g., smaller dimensions than the above-mentioned types or having the shape of a thin and elongated head.

This type of brush has the drawback of being poorly suited for applications that require a spreading of cosmetic products on quite large areas (e.g., the cheeks, forehead and the like).

In precision applications, therefore, it is necessary to use a multitude of brushes that complicates operations and compromises the final result.

The need is therefore known to simplify and speed up the application operations of cosmetic products without having to give up satisfactory final results.

To obviate at least in part to these drawbacks, from patent documents WO 2015/025873 and US 2010/077559 other types of brush are known having different density portions intended to widen the possibilities of using the brush itself and of the final visual effects obtainable with the latter.

In both documents, the described brushes have the head divided into a first portion having a substantially flat spreading surface and a second portion protruding with respect to the first portion.

In such embodiments, the conformation of the spreading surface makes difficult to take the cosmetic products from the containers in which they are packaged, especially in the case of cosmetic products being partially consumed, or in the case of containers having irregular shapes.

Furthermore, the particular conformations of the brush heads make them totally unsuitable for precision applications, particularly if directed to small areas.

The brushes described in these documents are, therefore, susceptible of further improvements.

DESCRIPTION OF THE INVENTION

The main aim of the present invention is to provide a brush for the application of cosmetic products which enables to perform the application operations of cosmetic products in a fast and accurate manner.

One object of the present invention is to provide a brush for the application of cosmetic products which enables to facilitate the taking of the required amount of product by the user.

Another object of the present invention is to provide a brush for the application of cosmetic products which has a dual function, allowing the taking and the application of cosmetic products in an even and accurate manner and, in parallel, allowing the spreading of cosmetic products in a rapid and easy manner.

A further object of the present invention is to provide a brush for the application of cosmetic products which allows the homogeneous taking of the cosmetic products from the inside of the containers in which they are packaged, even in the case of partially consumed products or of containers having irregular shapes.

Yet another object of the present invention is to provide a brush for the application of cosmetic products which allows to overcome the mentioned drawbacks of the prior art within the ambit of a simple, rational, easy and effective to use as well as affordable solution.

The above mentioned objects are achieved by the present brush for the application of cosmetic products having the characteristics of claim 1.

BRIEF DESCRIPTION OF THE DRAWINGS

Other characteristics and advantages of the present invention will appear better evident from the description of two preferred, but not exclusive, embodiments of a brush for the application of cosmetic products, illustrated by way of an indicative, but non-limiting, example in the accompanying drawings, wherein:

FIG. 4 is a view of the brush according to the invention in a third embodiment;

FIG. 5 is an exploded view of the container of FIG. 4;

EMBODIMENTS OF THE INVENTION

Figure 2:
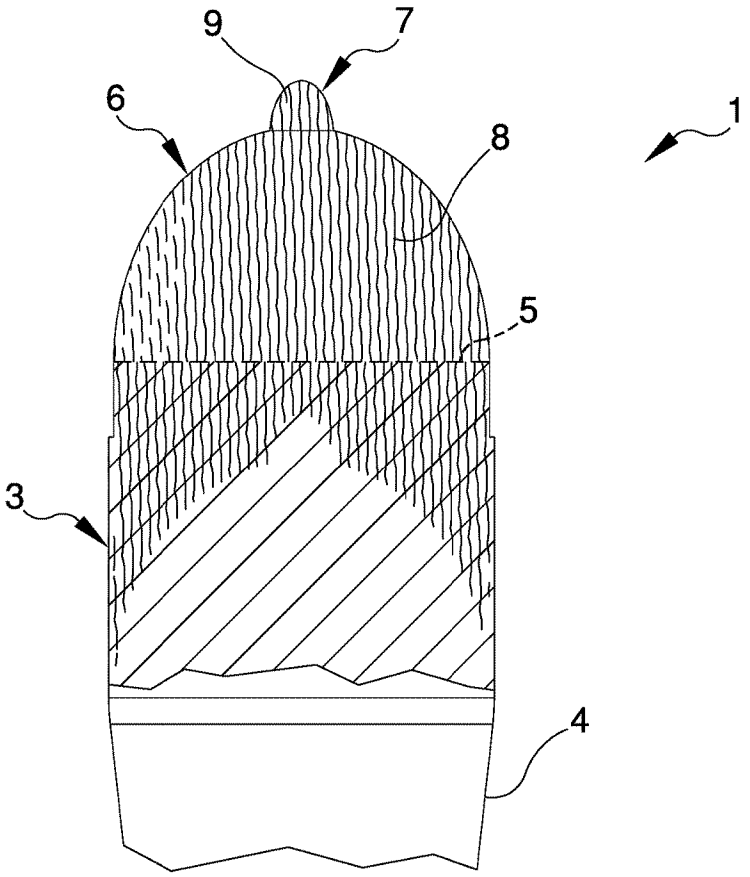
FIG. 2 is a partial side view of a detail of the brush according to the invention.

With particular reference to such figures, reference number 1 globally indicates a brush for the application of cosmetic products.

As part of this discussion the words "cosmetic product" refer to any substance or mixture of substances intended to be applied on the outer surfaces of the human body in order to change its appearance, clean, perfume, protect or vary its odors.

Cosmetic products can be, e.g., blush, face powder, nail enamel, lipstick, eye shadow, eye-liner, gloss and the like.

The brush 1 comprises a grip body 2 having a housing seat 3 made to measure for a plurality of hairs 6, 7.

In particular, the housing seat 3 is substantially cylindrical.

The housing seat 3 has the function of housing and retaining the plurality of hairs 6, 7 adapted to take, apply and spread cosmetic products 10 on a user.

In this specification, the term "user" refers to the person intended to use the cosmetic product 10, not necessarily the same person who uses the brush 1.

Conveniently, but not necessarily, the plurality of hairs 6, 7 is composed of hairs having the same length, so as to avoid selection operations of the hairs in the manufacturing phase of the brush 1.

According to the invention, the plurality of hairs 6, 7 is divided into a first group of hairs 6, adjacent to one another and fitted to measure in the housing seat 3, and a second group of hairs 7, adjacent to one another and inserted in the first group of hairs 6.

The first group of hairs 6 defines a convex spreading surface 8 which is adapted precisely to spread cosmetic products 10 on the user.

In these embodiments, the spreading surface 8 is especially adapted to spread widely the cosmetic products 10 on the desired surfaces.

It cannot however be ruled out flattened conformations of the spreading surface 8 or with shapes other than the aforementioned three-dimensional ones.

Figure 9:
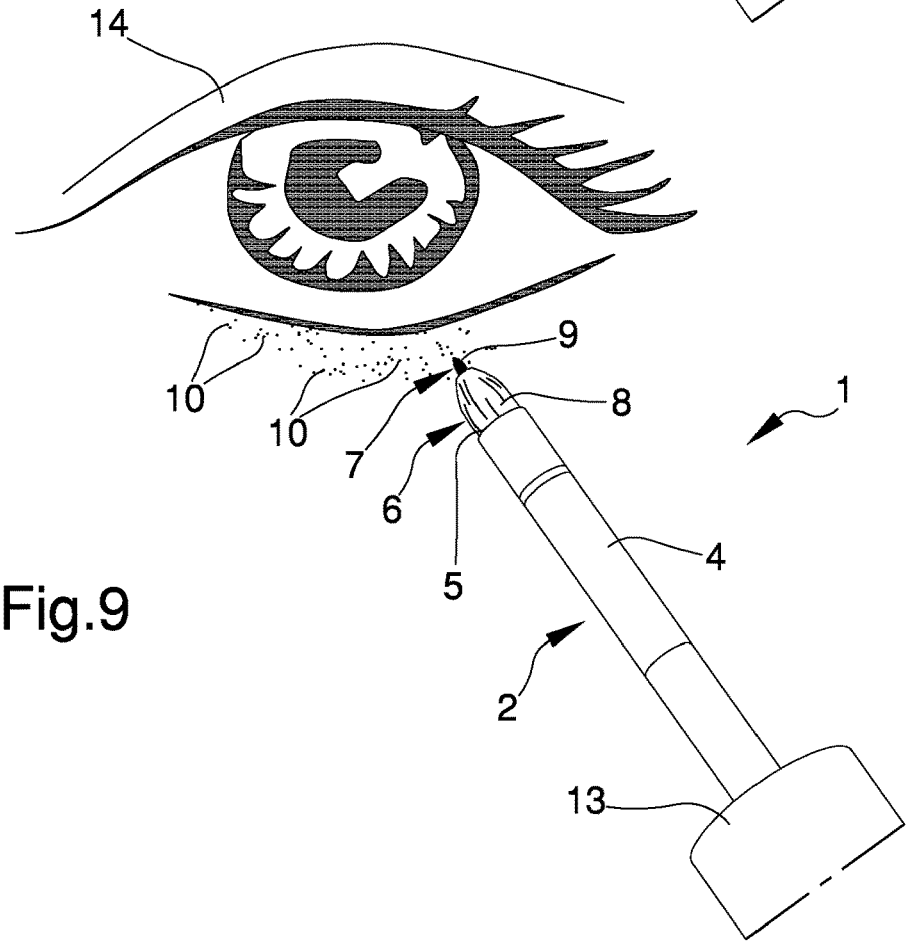

The second group of hairs 7, on the other hand, defines a taking and application surface 9 which protrudes with respect to the spreading surface 8 and is able to take the cosmetic products 10 and to apply them in a point-like manner on the user (FIG. 9).

In this specification, the term "taking" means one of the following operations:

the operation by which the taking and application surface 9 is made to run directly in contact on the surface of a cosmetic product 10 contained, e.g., in an open air container (as is usually the case for powder products such as blush, bronzing powder, eye shadow and the like), so as to take a desired amount of the same product;

the operation by which a certain amount of cosmetic product, e.g., contained in tubes, vials or the like (as is usually the case for products having a liquid or pasty texture such as foundation, cream, gel, serum and the like), is deposited on the taking and application surface 9.

By "point-like application" and similar terms, on the other hand, is meant the application on small areas, almost point-like, of an amount of cosmetic product intended to be spread or to be used for precision make-ups, finishing, or on smaller surfaces, such as e.g. the contour area of eyes, or lips or hairline (FIGS. 6-9).

In these embodiments, the second group of hairs 7 is arranged centrally in the first group of hairs 6.

In particular, the second group of hairs 7 protrudes from the center of the spreading surface 8 defining a protuberance subtended by the taking and application surface 9.

According to the invention, the spreading surface 8 has a substantially pointed shape adapted to increase the accuracy of the taking and application operations.

Alternative solutions cannot be ruled out, wherein the second group of hairs 7 is arranged in a different position to the central one, e.g., in a lateral or off-centered position with respect to the spreading surface 8, or wherein, the same group of hairs, defines a surface of different shape (e.g., triangular, star) and not necessarily pointed.

Solutions cannot also be ruled out, wherein there are several second groups of hairs 7 arranged on positions different to one another.

The first group of hairs 6 is made of a first type of material and the second group of hairs 7 is made of the same first type of material.

Usefully, the first type of material consists, in addition to traditional materials of animal origin, of synthetic yarn or nylon or silicone and other similar synthetic materials.

The alternative solution cannot be ruled out wherein the first group of hairs 6 is made of a first type of material and the second group of hairs 7 is made of a second type of material different to the first type.

The second type of material also consists, in addition to traditional materials of animal origin, of synthetic yarn or nylon or silicone or other similar synthetic materials.

This way it is possible to create combinations of different materials defining the head of the brush and particularly adapted to perform the different taking, application and spreading operations of the cosmetic products.

For example, it is possible to make brushes 1 having the spreading surface 8 made of hairs in synthetic yarn and the taking and application surface 9 made of silicone.

Figure 1:
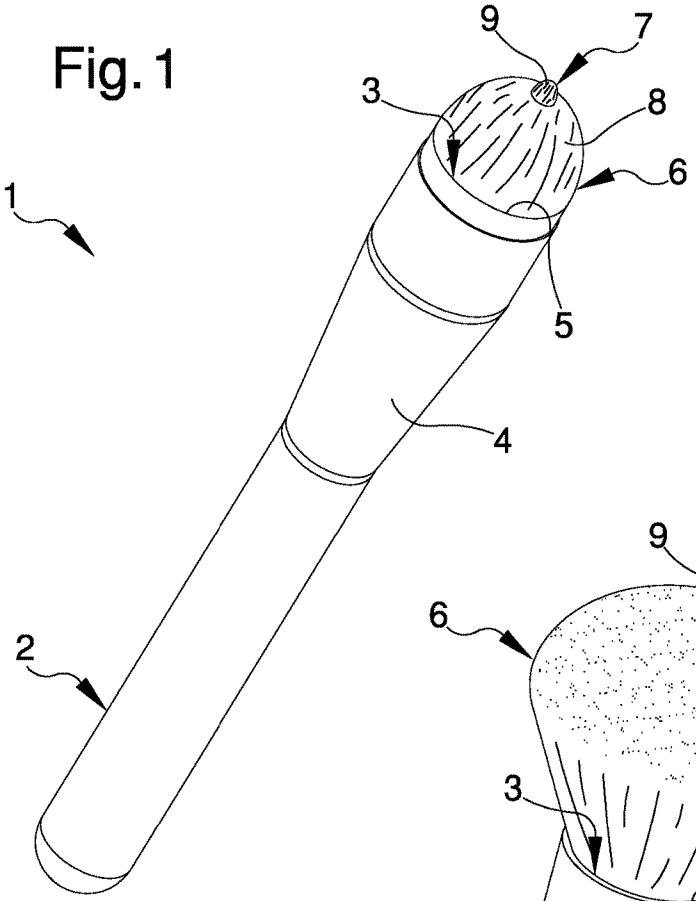
FIG. 1 is an axonometric view of a first embodiment of the brush according to the invention.

In a first embodiment, illustrated in FIG. 1, the grip body 2 comprises a widened extremity 4 having an opening 5 that defined the housing seat 3.

In this first embodiment, the grip body 2 has an elongated shape which, at the widened extremity 4, widens so as to define a truncated cone.

The end portion of the widened extremity 4 is open and the corresponding opening 5 defines a substantially cylindrical seat adapted to house the plurality of hairs 6, 7 defining the head of the brush 1.

The spreading surface 8 is substantially hemispherical.

Figure 3:
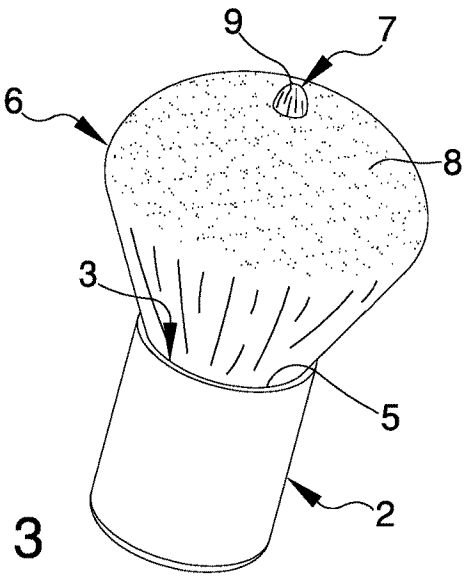
FIG. 3 is an axonometric view of a second embodiment of the brush according to the invention.

In a second embodiment, illustrated in FIG. 3, the grip body 2 has a square shape, substantially cylindrical and defining the housing seat 3.

In this second embodiment, the first group of hairs 6 takes a voluminous enlarged conformation which defines a substantially ellipsoidal spreading surface 8, and the second group of hairs 7 is arranged centrally to the spreading surface itself.

It cannot however be ruled out conformations of the grip body 2 different to those described previously, adapted e.g. to improve the ergonomic appearance of the brush 1.

Solutions cannot be ruled out with a grip body 2 having different shapes to the elongated one illustrated in the figures, and a different conformation cannot be ruled out for the housing seat 3, e.g. cylindrical, ellipsoidal or reverse conical, i.e. with a larger hanging towards the grip body 2 and narrower towards the hair escaping area.

Different solutions cannot however be ruled out providing conformations of the spreading surface 8 different to those mentioned, as well as other three-dimensional forms, not necessarily regular.

The operation of the first and of the second embodiment is as follows.

Through the grip body 2, the brush 1 is moved and approached to the appropriate containers to take a certain amount of cosmetic product 10.

In particular, the second group of hairs 7 is immersed into the product container in order to capture the desired amount of cosmetic product 10.

The latter is subsequently applied in a point-like manner on the user's surface to make up.

If a precision operation is required, as finishing near the eyes or mouth, one can simply move the brush 1 and run the second group of hairs 7 on the areas to make up.

Keeping in contact with the area to make up only the second taking and application surface 9, in fact, it is possible to spread the product in an accurate manner along the areas concerned.

If it is required an even spreading of the product on larger surfaces, e.g., by coating the cheeks or the forehead with foundation, then it is possible to use the first group of hairs 6 for spreading the product on the area concerned.

By pressing and moving the brush 1 with force against the surface to make up, one can take advantage of the first spreading surface 8 to spread the product previously applied in a point-like manner.

Finally, in the FIGS. 4-9 a third embodiment of the brush 1 is shown.

The brush 1 comprises the convex spreading surface 8, specifically substantially hemispherical, adapted to spread the cosmetic products 10 on the user, and a second group of hairs 7 adjacent to each other and inserted in the first group of hairs 6.

The second group of hairs 7 defines a taking and application surface 9 which is protruding with respect to the spreading surface 8, has a substantially pointed shape and is suitable for taking cosmetic products 10 and for their point-like or linear application on the user (FIGS. 6-9).

It is useful to point out that "linear application" and similar terms refer to the application on small surfaces of an amount of cosmetic product 10 intended to be drawn to define a linear stretch with clearly defined edges.

The brush 1 also comprises a grip body 2 having an elongated shape and which can be fitted substantially to measure inside a container body 12.

Advantageously, the grip body 2 comprises a hooking portion 13 opposite to the housing seat 3 and associable with the container body 12 for the closing of the latter.

As visible in FIGS. 6-9, the third embodiment is particularly suitable for precision applications, such as those required for the lips and eyes.

Figure 6:
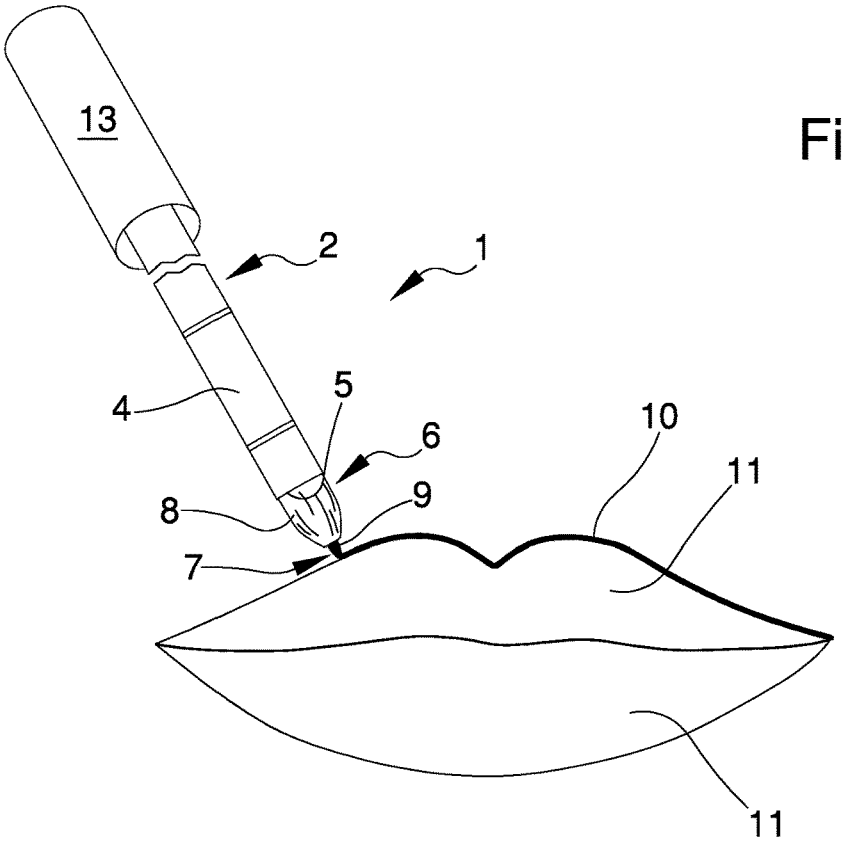
FIGS. 6-9 are schematic representations of the brush of FIG. 4 in different modes of use.

For this purpose, in fact, the taking and application surface 9 is used to take the cosmetic products 10 and apply them on the contours of the user's lips 11 (FIG. 6).

Figure 7:
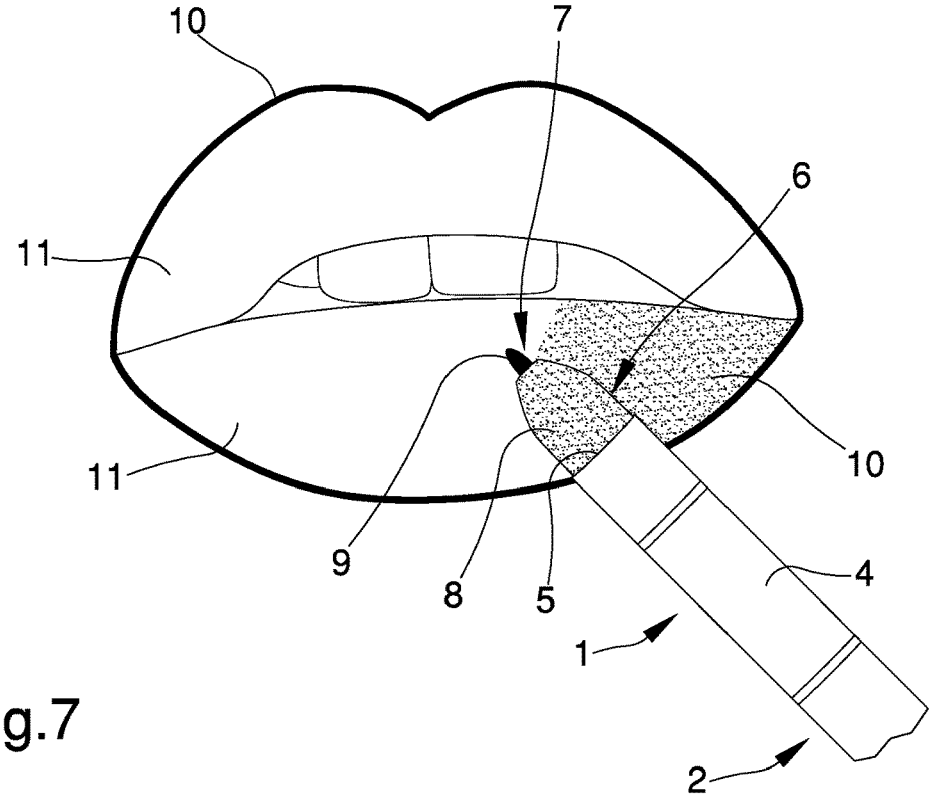

In parallel, the spreading surface 8 is used to spread the cosmetic products 10 on the user's lips 11 (FIG. 7).

In detail, the pointed shape of the taking and application surface 9 allows to take the cosmetic products 10 even in small amounts and, in parallel, to apply them on small areas, precisely like the lips 11.

As shown in FIGS. 6 and 7, the pointed shape of the taking and application surface 9 allows to define a thin stretch and with clearly defined edges, and just running along the contours of the lips 11.

Figure 8:
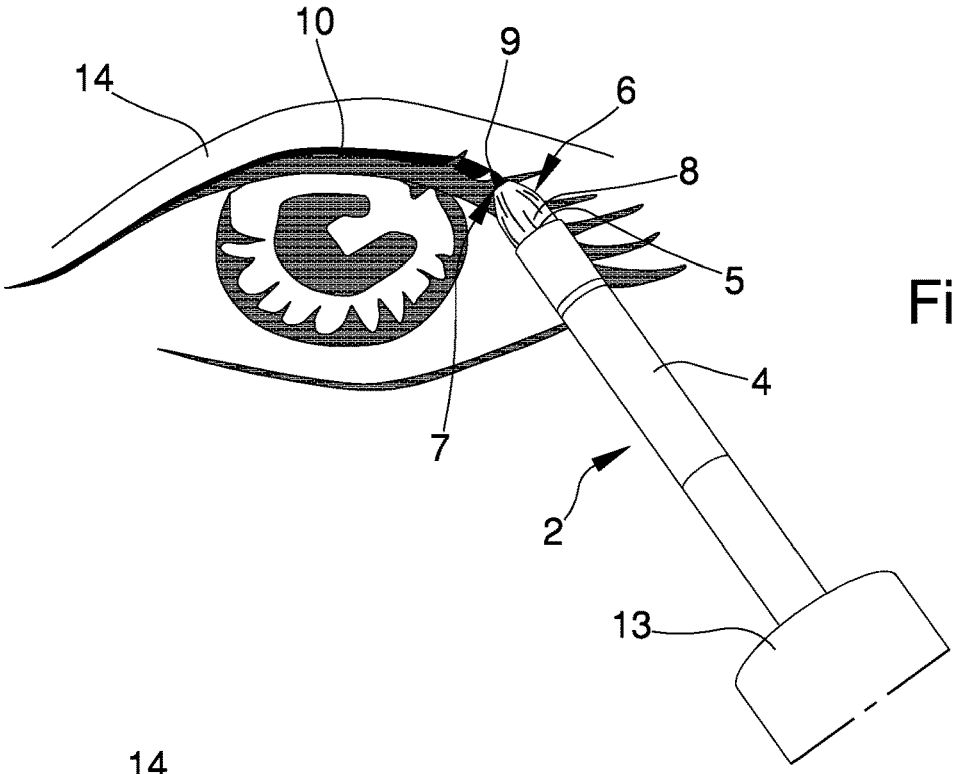

In parallel, in FIGS. 8 and 9 is shown another mode of use of the third embodiment of the brush 1 wherein the latter is used in the area of the eye 14 of the user. In particular, FIG. 8 shows the use of the brush 1 to draw the cosmetic product 10, by means of the taking and application surface 9, to define a linear stretch.

It has been found in practice that the described invention achieves the intended objects.

The fact is underlined that the particular expedient to provide a convex spreading surface and a pointed taking and application surface enables to obtain a brush having a dual function, i.e. to enable the taking and application of cosmetic products in a targeted and accurate manner and, in parallel, to spread it evenly and accurately.

The particular conformations of the taking and application surface and of the spreading surface also enable to take the cosmetic products homogeneously from the inside of the containers in which they are packaged, regardless of the shape of the latter.

Specifically, the taking and application surface defined by the second group of hairs forms a protuberance particularly suited to be used as application end, both to have amounts of product to be spread afterwards and to perform precision operations on small surfaces to make up.

Furthermore, the devised brush facilitates the taking of the required amounts of product by the user.

The taking and application surface, in fact, allows to take controlled doses of product.

This way it is possible to take the product without introducing the entire spreading surface inside the containers, avoiding, therefore, that considerable amounts of material are wasted or applied in a disorderly and inaccurate manner.

The invention claimed is:

1. A cosmetic brush comprising:

a grip body having at least a housing seat made to measure for a plurality of hairs adapted to take, apply and spread cosmetic products on a user, wherein said plurality of hairs is divided into:

a first group of hairs adjacent to one another and fitted to measure in said housing seat and defining a convex and hemispherical spreading surface which is adapted to spread said cosmetic products on said user; and a second group of hairs adjacent to one another and inserted in said first group of hairs, defining a taking and application surface which is protruding with respect to said spreading surface and has a substantially pointed shape and is suitable for taking said cosmetic products and for their point-like application on said user.

2. The brush according to claim 1, wherein said plurality of hairs comprises hairs having the same length.

3. The brush according to claim 1, wherein said second group of hairs is arranged centrally in said first group of hairs.

4. The brush according to claim 1, wherein said first group of hairs is made of a first type of material and said second group of hairs is made of said first type of material.

5. The brush according to claim 1, wherein said first group of hairs is made of a first type of material and said second group of hairs is made of a second type of material other than said first type.

6. The brush according to claim 1, wherein said grip body comprises a widened extremity having an opening defining said housing seat.

7. The brush according to claim 1, wherein said housing seat is substantially cylindrical.

8. The brush according to claim 1, wherein said grip body has an elongated shape and can be fitted substantially to measure inside a container body.

9. The brush according to claim 8, wherein said grip body comprises a hooking portion opposite to said housing seat and associable with said container body for the closing of said container body.

10. A cosmetic brush comprising:

a grip body having at least a housing seat made to measure for a plurality of hairs adapted to take, apply and spread cosmetic products on a user, wherein said plurality of hairs is divided into:

a first group of hairs adjacent to one another and fitted to measure in said housing seat and defining a convex and ellipsoidal spreading surface adapted to spread said cosmetic products on said user, wherein a width of the spreading surface is larger than a width of the housing seat; and a second group of hairs adjacent to one another and inserted in said first group of hairs, defining a taking and application surface that protrudes with respect to said spreading surface and has a substantially convex shape and is suitable for taking said cosmetic products and for their point-like application on said user.

11. A cosmetic brush comprising:

a grip body having at least a housing seat made to measure for a plurality of hairs adapted to take, apply and spread cosmetic products on a user, wherein said plurality of hairs is divided into:

a first group of hairs adjacent to one another and fitted to measure in said housing seat such that the first group of hairs defines a convex and hemispherical spreading surface adapted to spread said cosmetic products on said user, wherein the convex and hemispherical spreading surface is defined by the first group of hairs extending a distance away from the housing seat, the distance increasing from an exterior of the first group of hairs toward a center thereof; and a second group of hairs adjacent to one another and inserted in said first group of hairs, defining a taking and application surface that protrudes with respect to said spreading surface and has a substantially convex shape and is suitable for taking said cosmetic products and for their point-like application on said user.

* * * * *